US006451716B1

(12) United States Patent
Sasaki et al.

(10) Patent No.: US 6,451,716 B1
(45) **Date of Patent: *Sep. 17, 2002**

(54) LEATHER-LIKE SHEET AND PROCESS FOR THE PRODUCTION THEREOF

(75) Inventors: Kunihiko Sasaki; Yoshiyuki Suzuki, both of Shimane (JP)

(73) Assignee: Teijin Limited, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/331,731

(22) PCT Filed: Oct. 29, 1998

(86) PCT No.: PCT/JP98/04900

§ 371 (c)(1),
(2), (4) Date: Jun. 24, 1999

(87) PCT Pub. No.: WO99/24658

PCT Pub. Date: May 20, 1999

(30) Foreign Application Priority Data

Nov. 10, 1997 (JP) ..... 9-307364

(51) Int. Cl.[7] ..... B32B 27/04; B32B 27/12; B32B 5/18; D04H 1/00

(52) U.S. Cl. ..... 442/77; 428/904; 442/65; 442/66; 442/168; 442/340

(58) Field of Search ..... 442/60, 64, 62, 442/66, 76, 77, 168, 340; 428/904

(56) References Cited

U.S. PATENT DOCUMENTS 5,518,800 A * 5/1996 Okawa et al. ..... 428/151

FOREIGN PATENT DOCUMENTS

JP 56134274 A * 10/1981
JP A 4-185777 7/1992

* cited by examiner

*Primary Examiner*—Blaine Copenheaver
*Assistant Examiner*—Christopher L. Pratt
(74) *Attorney, Agent, or Firm*—Sughrue Mion, PLLC

(57) ABSTRACT

Provided is a leatherlike sheet material which has a base material (I) comprising a nonwoven fabric (A) constituted with ultrafine-fiber bundles having single fineness of no greater than 0.2 de, a high molecular elastomer (B) and a high molecular elastomer (C), and in which a grained surface layer (II) comprising a high molecular elastomer (C)-constituted surface porous layer (D) and a surface finishing layer (E) is formed on at least one side of the surfaces of the base material (I), wherein the leatherlike sheet material is characterized in that the apparent density of the base material (I), the weight ratio of the nonwoven fabric (A) to the high molecular weight elastomer (B) and the high molecular elastomer (C) in the base material (I), the thickness of the grained surface layer (II), and the ratios of 20%-elongation load ($\sigma 20$)/5%-elongation load ($\sigma 5$) in the longitudinal direction and the transverse direction of the leatherlike sheet material satisfy their own specific ranges.

6 Claims, No Drawings

LEATHER-LIKE SHEET AND PROCESS FOR THE PRODUCTION THEREOF

TECHNICAL FIELD

The present invention relates to leatherlike sheet, materials thin in thickness, rich in softness, having low impact resilience and high strength, and having a resemblance to kangaroo-leather, and a method for producing same. More particularly, the present invention concerns leatherlike sheet materials having high peel-off strength between layers, excellent in air permeability and moisture permeability, and having a kangaroo-like design, and a method for producing same.

BACKGROUND ART

Heretofore, various proposals have been made for leatherlike sheet materials having softness like natural leathers. For example, Japanese Patent Publication No. 63-5518 has proposed the following processes: an entangled nonwoven fabric comprising ultrafine fibers having single fineness of no greater than 1 de is impregnated with a polyurethane resin, then the nonwoven fabric is subjected to wet-type coagulation to obtain a base material, on the base material is laminated a film prepared by applying a polyurethane resin on a release paper, or on the base material is applied a polyurethane solution, the resultant polyurethane resin-coated nonwoven fabric is subjected to a wet-type coagulation treatment again, and subsequently a polyurethane resin-based colored coating material is applied by a gravure roll; or an entangled nonwoven fabric comprising islands-in-a-sea type multi-component fibers is impregnated with a polyurethane resin, the resultant polyurethane resin-impregnated nonwoven fabric is subjected to a wet-type coagulation treatment, subsequently one component of the multi-component fiber is dissolved by a solvent or the like to remove the component to convert the fibers into ultrafine-fiber bundles having a single fineness of no greater than 0.2 de, and then the above-mentioned surface finishing processing is applied on the base material comprising the ultrafine-fiber bundles. The leatherlike sheet materials obtained by these processes have properties close to natural leathers in softness. However, a leatherlike sheet material having softness, body feeling (stiffness) and leather-like low resiliency at the same time, and further having good air permeability and moisture permeability has not been obtained yet.

Further, as a manmade leather which is soft and has body feeling (stiffness); Japanese Unexamined Patent Publication No. 4-185777 has proposed a sheet material which is prepared by using a high density nonwoven fabric and in which the amount of the impregnated resin is controlled to a low level. However, the proposed sheet material is short in soft feeling of the surface, insufficient in a peel-off strength between layers as for a material for shoes which is used under severe conditions, and also poor in air permeability and moisture permeability.

The object of the present invention is to provide leatherlike sheet materials thin in thickness, rich in softness, having low impact resilience and high strength, and having a kangaroo-like design; more particularly leatherlike sheet materials having high peel-off strength between layers, excellent in air permeability and moisture permeability, and having a kangaroo-like design, and to provide a method for producing same.

DISCLOSURE OF THE INVENTION

The inventors of the present invention have pursued extensive investigations for achieving the above-mentioned objects by finding a leatherlike sheet material which has a base material (I) comprising a nonwoven fabric (A) constituted with ultrafine-fiber bundles having single fineness of no greater than 0.2 de, a high molecular elastomer (B) and a high molecular elastomer (C), and in which a grained surface layer (II) comprising a high molecular elastomer (C)-constituted surface porous layer (D) and a surface finishing layer (E) is formed on at least one side of the surfaces of the base material (I), wherein the leatherlike sheet material is characterized in that (1) the apparent density of the base material (I) is 0.37 to 0.65 g/cm$^3$, (2) the weight ratio of the nonwoven fabric (A) to the high molecular elastomer (B) and the high molecular elastomer (C) in the base material ( I) is 45:55 to 69:31, (3) the thickness of the grained surface layer (II) is 0.01 to 0.18 mm, and (4) the ratios of 20%-elongation load ($(\sigma 20)$/5%-elongation load ($\sigma 5$) in the longitudinal direction and the transverse direction of the leatherlike sheet material are each not less than 5 nor more than 20, and further by finding a method for producing same.

BEST MODE FOR CARRYING OUT THE INVENTION

Hereafter, the present invention will be explained in detail.

A leatherlike sheet material used in the present invention has a base material (I) comprising a nonwoven fabric (A) constituted with ultrafine fiber bundles having single fineness of no greater than 0.2 de, a high molecular elastomer (B) and the high molecular elastomer (C), and a grained surface layer (II) comprising a high molecular elastomer (C)-constituted surface porous layer (D) and a surface finishing layer (E) is formed on at least one side of the surfaces of the base material (I).

The nonwoven fabric (A) constituting the base material (I) of the leatherlike sheet material comprises ultrafine-fiber bundles having single fineness of no greater than 0.2 de. Examples of a high molecular polymer which forms the ultrafine fibers include polyamides such as nylon 6, nylon 66 and nylon 12, and polyesters such as polyethylene terephthalate and polybutylene terephthalate. Single fineness of the ultrafine fibers is no greater than 0.2 de, preferably no greater than 0.1 de, especially preferably 0.0001 to 0.05 de. The single fineness used here may be an average single fineness. The ultrafine fibers must be used in the form of bundles, and one bundle contains preferably 10 to 5000 ultrafine fibers, further preferably 100 to 2000.

Examples of the high molecular elastomer (B) include a polyurethane elastomer, polyurea elastomer, polyurethane polyurea elastomer, polyacrylic acid resin, acrylonitrile.butadiene elastomer, styrene butadiene elastomer and the like. Among them are preferable polyurethane group elastomers such as a polyurethane elastomer, polyurea elastomer and polyurethanepolyurea elastomer. These polyurethane elastomers are obtained by reacting one kind, or two or more kinds of polymeric glycols selected from polyether glycols, polyester glycols, polyesterether glycols, polycaprolactone glycols, polycarbonate glycols and the like having average molecular weight of 500 to 4000 with an organic diisocyanate such as 4,4'-diphenylmethane diisocyanate, xylylene diisocyanate, tolylene diisocyanate, dicyclohexylmethane diisocyanate and isophorone diisocyanate, and a chain extender selected from low molecular glycols, diamines, hydrazine derivatives such as hydrazine, organic acid hydrazides and amino acid hydrazides, and the like. The 100%-elongation modulus of the high molecular weight elastomer (B) is preferably 40 to 300 kg/cm$^2$. When the 100%-elongation modulus is less than 40 kg/cm$^2$, the obtained leatherlike sheet material is rich in softness, but it is poor in heat resistance, solvent resistance and the like, and on the other hand, when the 100%-elongation modulus exceeds 300 kg/cm$^2$, the obtained leatherlike sheet material has hard touch, and hence these cases are not preferable. The adjustment of the 100%-elongation modulus of the high molecular elastomer (B) into the preferable range can be easily attained, for example, by adjusting the amounts of organic diisocyanate and chain extender in the polymer when a polyurethane elastomer is used as the high molecular elastomer (B).

The impregnation of the high molecular elastomer (B) into a nonwoven fabric is generally carried out by using a solution or dispersion (including aqueous emulsion) of the high molecular elastomer (B) in an organic solvent. Here, as the solution containing a solvent for the high molecular elastomer (B), it is preferable to use a solution comprising a good solvent for the high molecular elastomer (B) such as dimethylformamide, diethylformamide, dimethylacetamide or tetrahydrofuran, or a solution prepared by adding water, an alcohol, methyl ethyl ketone or the like to said solution or the like. The solution containing a solvent for the high molecular elastomer (B) contains a solvent for the high molecular elastomer (B) preferably at least 50% or more, more preferably 70% or more, because a part of the above-mentioned high molecular elastomer (B) must be dissolved or swelled. The concentration of the high molecular elastomer (B) to be impregnated is 5 to 25%, preferably 10–20%, especially preferably 12 to 18%.

The high molecular elastomer (C) can be a similar elastomer to the above-mentioned high molecular elastomer (B), but the 100%-elongation modulus of the high molecular elastomer (C) is preferably 40–150 kg/cm$^2$. When it is less than 40 kg/cm$^2$, the obtained leatherlike sheet material is rich in softness, but it is poor in abrasion resistances heat resistance, solvent resistance and the like, and on the other hand, when it exceeds 150 kg/cm$^2$, the obtained leatherlike sheet material has hard touch, and is poor in the properties such as flexing resistance, hardness at low temperature and the like, and hence these cases are not preferable.

The high molecular elastomer (C) is used as the surface porous layer (D) besides used as an constituting component of the base material (I) That is, the high molecular elastomer (C) is applied at least one side of the surfaces of the nonwoven fabric (A), which has been impregnated with the high molecular elastomer (B) as the surface porous layer (D), and subsequently the high molecular elastomer (C) is made to soak into the nonwoven fabric (A) impregnated with the high molecular elastomer (B) so that the weight ratio of the nonwoven fabric (A) to the high molecular elastomer (B) and the high molecular elastomer (C) ranges from 45:55 to 69:31. Here, the weight of the nonwoven fabric (A) is the weight after the treatment for converting the constituting fibers into ultrafine fibers. When the total content of the high molecular elastomer (B) and the high molecular elastomer (C) is less than 31%, the absolute amount of the high molecular elastomers in the nonwoven fabric (A) is too small, and resiliency is low, but the reinforcing effect on the nonwoven fabric (A) by the high molecular elastomers is small, and hence the strength is insufficient for the use under severe conditions as in shoes or the like, and problems such as deformation and the like occur. On the other hand, When that ratio exceeds 55%, the resiliency unfavorably becomes too high. The soaking of the high molecular elastomer (C) into the nonwoven fabric (A) impregnated with the high molecular elastomer (B) can increase the peel-off strength between the base material (I) and the grained surface layer (II), and it can increase the peel-off strength preferably up to 2.5 kg/cm.

The apparent density of the base material (I) is preferably 0.37 to 0.65 g/cm$^3$, especially preferably 0.39 to 0.60 g/cm$^3$.

As mentioned above, the surface porous layer (D) is formed on at least one side of the surfaces of the base material (I) and the surface porous layer (D) is a porous layer comprising the above-mentioned high molecular elastomer (C). A finishing layer (E) is further formed on the surface of the porous layer (D), and it is important that the finishing layer (E) is constituted, with a high molecular elastomer that can keep the quality of appearance, durability, abrasion resistance, weather resistance, color fastness and the like. Concretely, the examples of the finishing layer (E) can include a polyurethane polymer, polyamino acid resin, polyamide resin, polyacrylic acid resin and the like. It is preferable that the surface finishing layer (E) is 5 to 100 $\mu$m thick when the 100%-elongation modulus of the polymer that is applied for forming it is in the range of 60–150 kg/cm$^2$, and the surface finishing layer (E) is 3 to 30 $\mu$m thick when the 100%-elongation modulus is in the range of 150 to 300 kg/cm$^2$. These surface porous layer (D) and surface finishing layer (E) are totally referred to as the grained surface layer (II). The thickness of the grained surface layer (II) is 0.01 to 0.18 mm, preferably 0.05 to 0.15 mm. The grained surface layer (II) preferably has fine pores, and it is preferable that the grained surface layer has fine pores of 0.5 to 40 $\mu$m in diameter at least 50 pores/cm$^2$ on the surface.

The leatherlike sheet material of the present invention is excellent in moisture permeability and air permeability, and it is preferable that the moisture permeability is at least 5 mg/cm$^2$·hr and the air permeability is at least 0.5 litter/cm$^2$·hr. Further, the ratios of 20%-elongation load ($\sigma$20)/5%-elongation load ($\sigma$5) in the longitudinal direction and the transverse direction of the leatherlike sheet material of the present invention must be each not less than 5 nor more than 20. When the ratio is less than 5, the leatherlike sheet material is poor in softness, and becomes easily extendible. On the other hand, the higher the upper limit is, the more preferable the leatherlike sheet material is; however, it is difficult to exceed 20 from the present technical level. When the ratio is controlled in this specific range, the obtained leatherlike sheet material becomes soft in touch, and even with large deforming Rower applied, the leatherlike sheet material does not extend too much and has a certain limiting condition of elongation.

A leatherlike sheet material of the present invention which has a base material (I) comprising a nonwoven fabric (A) constituted with ultrafine-fiber bundles having single fineness of no greater than 0.2 de, a high molecular elastomer (B) and a high molecular elastomer (C), and in which a grained surface layer (II) comprising a high molecular elastomer (C)-constituted surface porous layer (D) and a surface finishing layer (E) is formed on at least one side of the surfaces of the base, material, can be produced as follows:

(5) for producing the base material (I), a nonwoven fabric (a) constituted with fibers convertible into ultrafine-fiber. bundles is impregnated with a solution of the high molecular elastomer (B), the nonwoven fabric (a) is compressed to the thickness of 95% or less of its original thickness to be squeezed, successively a solution of the high molecular elastomer (C) is applied on the nonwoven fabric (a) before getting recovered from the compression to making a part of this solution permeate into the nonwoven fabric (a), subsequently the high molecular elastomer (B) and the high molecular elastomer (C) in the nonwoven fabric (a) are made to coagulate in such a state that they are substantially free from contact with the fibers convertible into ultrafine-fiber bundles constituting the nonwoven fabric (a), and the treated nonwoven fabric (a) is subjected to a solvent removing process and a drying process;

(6) the high molecular elastomer (C)-constituted surface porous layer (D) is formed on at least one side of the surfaces of the base material (I), subsequently the nonwoven fabric (a) is treated for, converting the constituting fibers into ultrafine fibers, and the resultant nonwoven fabric is pressed at a temperature in the range from the softening temperature minus 100° C. to the softening temperature minus 10° C. satisfied at the same time for the high molecular elastomer (B) and the high molecular elastomer (C) to reduce its thickness into 60–95% of the original thickness before or after the formation of a finishing layer (E) further on the surface; and (7) the leatherlike sheet material comprising the base material (I) and the grained surface layer (II) is subjected to a rubbing processing so that the ratios of 20%-elongation load ($\sigma 20$)/5%-elongation load ($\sigma 5$) in the longitudinal direction and the transverse direction of the leatherlike sheet material become each not less than 5 nor more than 20.

A nonwoven fabric (A) constituted with ultrafine-fiber bundles having a single fineness of no greater than 0.2 de is produced by initially forming nonwoven fabric (a) using fibers convertible into ultrafine-fiber bundles having a single fineness of no greater than 0.2 de, impregnating the obtained nonwoven fabric with a high molecular elastomer, and subsequently subjecting the impregnated nonwoven fabric to a treatment for converting the constituting fibers into ultrafine fibers to convert the nonwoven fabric (a) to the nonwoven fabric (A) constituted with ultrafine-fiber bundles having a single fineness of no greater than 10.2 de. Namely, "a fiber convertible into an ultrafine-fiber bundle having a single fineness of no greater than 0.2 de" means a fiber which can be converted into an ultrafine-fiber bundle having a single-fineness of no greater than 0.2 de by an after-treatment such as a solvent treatment or a dissolving-splitting treatment. The fiber convertible into an ultrafine-fiber bundle can be, for example, a composite fiber comprising multi components of high molecular polymers. Examples of the forms of the composite fiber include an islands-in-a-sea type, a side-by-side type and the like, and the island-in-a-sea type is preferred. Besides the above-mentioned polyamide and polyester, polyethylene, polypropylene, a high-molecular weight polyethylene glycol, polystyrene, polyacrylate and the like can be used as the high molecular polymers of the composite fibers.

Hereafter, methods for producing leatherlike sheet materials of the present invention will be explained with concrete examples.

Fibers convertible into ultrafine-fiber bundles, i.e. islands-in-a-sea type composite fibers, are processed to form a web by using a conventional machine such as a card, a random webber or a cross-layer. Needle-punching is applied on the obtained web in the direction of the thickness preferably at a barb-penetration punching density of 500 to 3000 punches/$cm^2$, particularly preferably of 800 to 2000 punches/$cm^2$, to entangle the fibers convertible into ultrafine-fiber bundles to form a nonwoven fabric (a). When the barb-penetration punching density is less than 500 punches/$cm^2$, the entanglement of the nonwoven fabric is insufficient, and the strength of the nonwoven fabric is poor. It is not preferable to use such a nonwoven fabric for producing a nubuck-like manmade leather since the obtained nubuck-like manmade leather is insufficient in a writing effect. Further, when the barb-penetration punching density is more than 3000 punches/$cm^2$, punching is unfavorably excessive since the entangled fibers suffer from great damage and a yielding phenomenon occurs in the obtained nonwoven fabric (A). The term "barb-penetration punching density" as used herein means the n umber of punches per $cm^2$ which are performed in the direction of thickness of a web, by using a needle having at least one barb, at the depth in which the front barb penetrates the web. It is preferable that the obtained nonwoven fabric (a) is heated to soften the sea component of the composite fiber, and subsequently the nonwoven fabric is pressed with a calender roll or the like to adjust the thickness, apparent density and surface smoothness. This adjustment can be carried out arbitrarily depending on the use of the objective leatherlike sheet material. It is however preferable that the resulting nonwoven fabric has, for example, the thickness of 0.4 to 6.0 mm, the apparent density of 0.25 to 0.45 g/$cm^3$ and flat surfaces. Herein, the pressing with a heated calender roil is especially preferable since the heat treatment and the press treatment can be applied simultaneously.

Thus obtained nonwoven fabric (A) is impregnated with a solution or dispersion of a high molecular elastomer (B), and the polymer is coagulated to produce a base material (I).

The impregnation of the above-mentioned high molecular elastomer (B) into a nonwoven fabric (a) is generally carried out using a solution or dispersion (including aqueous emulsion) of the high molecular elastomer (B) in an organic solvent. Here, as the solution containing la solvent for the high molecular elastomer (B), it is preferable to use a solution comprising a good solvent for the high molecular elastomer (B) such as dimethylformamide, diethylformamide, dimethylacetamide or tetrahydrofuran, or the like. The concentration of the high molecular elastomer (B) to be impregnated is preferably 5 to 25%, especially preferably 10 to 20%, further preferably 12 to 18% from view points of softness and the like as a leatherlike sheet material.

The obtained base material is compressed to the thickness of 95% or less, preferably 60 to 95%, further preferably 65 to 96% of the original thickness of the base material to be squeezed, and successively a solution of the high molecular elastomer (C) is applied on the base material before getting recovered from the compression to make a part of the solution permeate into the nonwoven fabric (a), subsequently the high molecular elastomer (B) in the nonwoven fabric (a) is made to coagulate substantially in a non-contacting state with the fibers convertible into ultrafine-fiber bundles constituting the nonwoven fabric (a), and the treated nonwoven fabric (a) is subjected to a solvent removing process and a drying process. Here, "to coagulate in a non-contacting state" means to coagulate the high molecular elastomers (B) and (C) which surrounds the fibers convertible into ultrafine-fiber bundles leaving the fibers in a state where the elastomers do not bond the whole parts of the fibers but partly leave spaces between the elastomers and the fibers in the region where the fibers are crossed or not crossed with each other. In order to get such a coagulation state, the surface of the nonwoven fabric (a) is pretreated with a substance such as an organo silicone or a fluorine compound, which can prevent the bonding between the high molecular elastomers (B) and (C), and the fibers convertible into ultrafine-fiber bundles; or the amounts of the addition of the wet-type coagulant, the pore-controlling agent and the like into the solutions of the high molecular elastomers (B) and (C) for coagulating them are adjusted to change the balance between hydrophobicity and hydrophilicity so that the high molecular elastomers (B) land (C) coagulate separately from the ultrafine fibers.

Subsequently, on the surface of the high molecular elastomer (C) is applied a solution containing a solvent for the high molecular elastomer (C) by using a gravure roll having a 50 to 250 mesh size to partly dissolve the skin layer to form open pores, that is, a surface porous layer (D) is formed. In concrete, when the high molecular elastomer (C) is a polyurethane-based elastomer, a solvent composed of 50 to 100% of dimethyl formamide, dimethyl acetamide or the like is applied by using the above-mentioned gravure mesh roll at the rate of 1 to 10 g/m$^2$, and the nonwoven fabric (a) is dried. By the solvent which is transferred by the mesh loll, the skin layer of the porous layer of the high molecular elastomer (C) is dissolved, and thereby open pores are formed. In the following solvent extraction for forming ultrafine-fiber bundles, the infiltration and, diffusion of the extraction solvent is stimulated owing to the resultant open pores, and the extraction speed is increased and production efficiency is improved. The open pores further can impart high air permeability and moisture permeability to the leatherlike sheet material, the final objective product.

Subsequently, the nonwoven fabric constituted with the fibers convertible into ultrafine-fiber bundles is subjected to a treatment for converting into ultrafine fibers. Here, "a treatment for converting into ultrafine fibers" is a treatment in which, when the fibers convertible into an ultrafine-fiber bundles consist of islands-in-a-sea type composite fibers, the nonwoven fabric is treated with a solvent which is a solvent for the sea component and at the same time which is a nonsolvent for the high molecular elastomers (B) and (C); or when the fibers convertible into ultrafine-fiber bundles consist of a side-by-side type fibber, the nonwoven fabric is split by a chemical treatment with a chemical which swells one component of the side-by-side type fiber or the like, or by using high-pressure water current or the like. In concrete, when the fibers are islands-in-a-sea type composite fibers obtained by mixed spinning of a low-density polyethylene and nylon 6, the low-density polyethylene is dissolved by hot toluene, hot xylene or the like; and when the fibers are a side-by-side type fibers obtained from nylon 6 and a polyethylene terephthalate-based polymer obtained by copolymerizing 2 to 8% of isophthalic acid sodium sulfonate, the fibers are immersed into a 2 to 5% caustic soda solution or treated with a 1 to 5% hydrochloric acid solution, and subsequently the fibers are subjected to a neutralization treatment and then the fibers are split by high-pressure water current.

Further, the nonwoven fabric is pressed under heating at a temperature in the range from the softening temperature of the high molecular elastomer (B) minus 10° C. to the softening temperature minus 100° C. to reduce its thickness into 95 to 60% of the original thickness. The treatment may be carried out before or after the process for the formation of a finishing layer (E) on the surface porous layer (D). In order to increase the density of the base material (I) as high as possible while the density of the surface porous layer (E) is kept as low as possible, it is preferable that the base material (I)-side is allowed to coming in contact with the higher temperature surface so that the temperature of the blase material (I) becomes higher, and the nonwoven fabric is pressed in such state. Thus obtained leatherlike sheet material, in which the density of the surface finishing layer (E) is kept low and the density of the base material (I) is increased, has a structure bearing a resemblance to "a structure having tight base side and loose grain side", which is a characteristic structure of a natural leather, and the sheet material has body feeling (i stiffness) and fine "sibo" feeling (crimp structure) at the same time, which is characteristic feeling to a natural leather. The apparent density of the base material (I) is 0.37 to 0.65 g/cm$^3$, preferably 0.39 to 0.60 g/cm$^3$. When the apparent density of the base material (I) is less than 0.37 g/cm$^3$, the base material is poor in body feeling, and when it exceeds 0.65 g/cm$^3$, the touch becomes hard, and hence these cases are not preferred. The apparent density of the grained surface layer (II) comprising the surface porous layer (D) and the surface finishing layer (E) is 0.35 to 0.65 g/cm$^3$, preferably 0.38 to 0.60 g/cm$^3$. When the apparent density of the grained surface layer (II) is less than 0.35 g/cm$^3$, the peel-off strength becomes weak, and when it exceeds 0.65 g/cm$^3$, the touch becomes hard, and hence these cases are not preferred.

The heating press treatment is preferably carried out at a temperature in the range from the softening temperature of the high molecular elastomer (B) minus 100° C. to the softening temperature of the high molecular elastomer (B). When the temperature is higher than the softening temperature of the high molecular elastomer (B), fusing occurs during the heating press treatment and touch is deteriorated, and hence such a case is not preferred. When the temperature is lower than the softening temperature minus 100° C., even if the pressing pressure is elevated, the density-increasing effect on the base material (I) is small and the object of the present invention is not attained. It is preferable that the heating press treatment is carried out under the conditions where the pressing temperature and the pressing pressure satisfy both the following equations (1) and (2).

$$(SP-100) \leqq T \leqq (SP-10) \quad (1)$$

$$(5\times10^3) \leqq P\times T \leqq (1\times10^5) \quad (2)$$

[here, T is a pressing temperature (°C.), and P is a pressing: pressure (kg/cm), both in a roll press; SP is the softening temperature, (°C.) of the high molecular elastomer (C)].

When P×T is smaller than $5\times10^3$, the pressing effect is not satisfactory, and when it is larger than $1\times10^5$, the change of thickness becomes too large, and hence such cases are not preferred. When the thickness after the heating press treatment is not less than 95% of the original thickness, the density-increasing effect on the base material (I) is small, and when it is not larger than 60%, the degree of fusing becomes too large and touch becomes hard, and hence these cases are not preferred. In concrete, the heating press treatment can be carried out, for example, by using a roll press machine in which a pair of rolls can be heated with a temperature difference between themselves, a belt-type heating machine which has heating rolls, a machine which is provided together with a heating chamber and A roll press, or the like. Subsequently, the surface finishing layer (E) is formed on the surface of the high molecular elastomer (C)-constituted surface porous layer (D). The formation of the surface finishing layer (E) is carried out by applying an organic solvent solution of a high molecular elastomer using a gravure roll coater, a reverse roll coater, a sprayer or the like. Or, the formation of the surface finishing layer (E) can be performed by sticking a film formed on a release paper with a binder or the like on the surface porous layer (D). In the above process, it is important that open pores on the surface porous layer (D) are not closed when the finishing layer (E) is formed on it. For this purpose, the concentration and the viscosity of the solution of the high molecular elastomer to be coated, the infiltration time after coating and the like must be controlled.

Subsequently, the obtained leatherlike sheet material is subjected to a rubbing processing. Examples of the rubbing processing include a method in which the sheet material is held by clamps and one of the clamps is driven so that the rubbing deformation is applied, a method in which the sheet material is passed between a pair of stakes having protrusions and it is rubbed and softened while pressed into between the stakes, and the like.

The leatherlike sheet material produced through these processes is excellent in air permeability and moisture permeability and has soft touch, and it is not elongated too much even when large deforming power is applied and has a certain limiting condition of elongation. Further, the leatherlike sheet material is suited for use as materials for shoes or the like since the peel-off strength between the base material (I )and the grained surface layer (II) is strong.

EXAMPLES

The present invention will be explained further in detail hereafter with examples, while the present invention is not restricted by the examples.

In the examples, measurements were carried out; according to the following methods.

(1) Thickness. The thickness was determined with a spring-type dial gauge (load 120 g/cm$^2$).

(2) Elongation modulus. A test piece taken from a resin film (about 0.1 mm thick) was tested for elongation at 100%/min with a constant-speed tension meter. The 100%-elongation load was determined, and the elongation modulus was expressed in "kg/cm$^2$". The test piece was prepared according to JIS-K-6301-2 type dumbbell specimen.

(3) $\alpha$20 and $\alpha$5. A test piece taken from a leatherlike sheet material was tested with a constant-speed tension meter, and the values of the load at 5%- and 20%-elongation were determined. The test piece was prepared according to JIS-K-6550 5-2-1.

(4) Softening temperature. A polymer sample was examined by using a Flow Tester under conditions of a heating rate of 1° C./min and a preliminary load of 2.18 kg, and the temperature at which the polymer started to flow was determined as its softening temperature.

(5) Moisture permeability. The moisture permeability was determined according to the method of JIS-K-6549.

(6) Air permeability. The time required for passing 50 cc of air was measured by using Gurley's Densometer according to the method of JIS-P-8117, and the air permeability was expressed in "liter/cm$^2$·hr".

(7) Apparent density of the grained surface layer or the base material layer. A test piece of 2.5 cm wide and 10 cm long was sliced at the boundary face between the grained surface layer and the base material layer in such a manner that the grained surface layer-side sheet does not contain fibers as a continuous layer. The thickness and the weight were measured for each of the grained surface layer-side sheet and the base material layer-side sheet, and apparent densities for both the sheets were calculated from these data.

(8) Peel-off strength. On the grained surface layerside of a test piece of 2.5 cm wide and 15 cm long, a PVC-sheet which was laminated with a plain weave cloth of the same size as the test piece was bonded with a urethane adhesive. The test piece was marked at 2-cm intervals to divide into 5 sections, and the peel-off strength for every section was examined by using a constant-speed tension meter at a speed of 50 mm/min. The peel-off strengths observed here were recorded, and the minimum value in each of the 5 sections having a 2-cm interval was read, and the average value of the 5 sections was expressed in terms of "kg/cm".

(9) "Touch" in Table 1, Table 2 or Table 3 was rated into ◎: excellent, ○: good and ×: hard.

(10) "Stiffness" in Table 1, Table 2 or Table 3 was rated into ◎: excellent, ○: good and ×: insufficient.

(11) "Surface sibo-feeling" in Table 1, Table 2 or Table 3 was rated into ◎: excellent, ○: good and ×: large crimps.

Examples 1-(1), (2) and (3), and Comparative Example 1

Preparation of Nonwoven Fabric (A)

Nylon 6 and a low density polyethylene were mixed spun at a ratio of 50/50 to obtain islands-in-a-sea type composite fibers having a fineness of 4.5 de and a cut length of 51 mm. The fibers were converted into web by using a card and a cross layer, and the web was needle punched at a punching density of 1000 punches/cm$^2$ by using a needle locker. Subsequently, the web was heated in a hot-air chamber at 150° C. and pressed with a calender roll at 90° C. to obtain a nonwoven fabric (a) having a weight of 450 g/m$^2$, a thickness of 1.6 mm and an apparent density of 0.28 g/cm$^3$.

Preparation of Impregnation Solution

A mixture of a polytetramethylene glycol (Mw of 1480) and a polyhexamethylene adipate (Mw of 1500) at a molar ratio of 50/50 as a polymer diol, diphenylmethane diisocyanate and ethylene glycol were made to react with each other in dimethylformamide (hereafter, abbreviated as DMF) to obtain a high molecular elastomer (B) comprising a polyurethane elastomer (100%-elongation modulus of 160 kg/cm$^2$; and softening point of 205° C.). To a 15% solution of the obtained high molecular elastomer (B) were added an alkylene ether-modified silicone, a carbinol-modified silicone, a cellulose-based additive and a black toner to prepare an impregnation solution.

Preparation of Surface-Coating Solution

A mixture of a polytetramethylene glycol (Mw of 1980) and a polyhexamethylene adipate (Mw of 2000) at a molar ratio of 50/50 as a polymer diol, diphenylmethane diisocyanate and ethylene glycol were made to react with each other in DMF to obtain a high molecular elastomer (C) comprising a polyurethane elastomer (100%-elongation modulus of 90 kg/cm$^2$; and softening point of 180° C.). To a 20% solution of the obtained high molecular elastomer (C) were added an alkylene ether-modified silicone, a carbinol-modified silicone, a cellulose-based additive and a black toner to prepare a surface-coating solution to be applied as the surface porous layer (D).

Preparation of Base Material (I) Having Porous Layer

Said nonwoven fabric (a) was immersed into said impregnation liquid, then the impregnated nonwoven fabric was introduced onto rotating metallic rolls, the impregnated liquid was squeezed out while the impregnated nonwoven fabric was pressed onto the metallic roll and compressed until its thickness becomes 90% of the original thickness by using a doctor knife utilizing the springing of a steel plate, and said coating liquid was applied onto the impregnated nonwoven fabric in an amount of 550 g/m$^2$ at the outlet side before the compression get recovered. Subsequently, the nonwoven fabric was immersed into a 12% DMF coagulation bath to coagulate the impregnated elastomer, and it was washed to remove the solvent followed by drying. Subsequently, the nonwoven fabric was immersed into hot toluene at 80° C. to remove the polyethylene of the sea component in the islands-in-a-sea type composite fiber by extraction, and thereby ultrafine fibers were obtained. The obtained ultrafine fibers had an average single fineness of 0.003 de.

Through these processes, a sheet material in which a high molecular elastomer (C)-constituted surface porous layer! (D) was formed on one side of the surfaces of the base material (I) was obtained. The observation of the structure of the cross-section of the obtained sheet material by a scanning electron microscope revealed that the polyurethane resin was coagulated with slight spaces around fibers that is, the sheet material had substantially a non-contacting structure, and further the high molecular elastomer (C) was sunk into the base material (I) by about 0.15 mm. Further, the sheet material was sliced at the boundary between the base material (I) and the surface porous layer (D), and the ratio of the fiber component to the sum of the high molecular elastomer (B) and the high molecular elastomer (C) in the base material (I) was determined by a solvent extraction method, and it was 56:44.

Formation of Surface Finishing Layer (E)

A coating material prepared by adding a black toner to an organic solvent solution containing 10% polyurethane resin (aromatic isocyanate-based polyester/polyether polyurethane; 100%-elongation modulus of 250 kg/cm$^2$) was used for forming the surface finishing layer (E). The coating material was applied twice on the surface porous layer, (D) of the base material by using a gravure roll having a 110 mesh size, and the coated base material was dried and then embossed at 180° C. by using an embossing pattern of a calf skin-pore design. A coating material prepared by adding a gloss-adjusting agent (silica) to the above-prepared coating material was further applied single time by using a gravure roll having a 110 mesh size, and the base material was dried. The resultant sheet material had a thickness of 1.26 mm, a weight of 480 g/m$^2$ and an apparent density of 0.38 g/Cm$^3$.

Pressing Treatment

Subsequently, the base material (I)-side and the grained surface layer (II)-side of the sheet material were brought in contact with smooth metallic rolls at 180° C. and at 80° C., respectively, and the sheet material was pressed at a pressing pressure of 35, 200 or 400 kg/cm, (linear load) and a linear velocity of 2 m/min.

Rubbing Processing

The pressed sheet material was subjected to a rubbing processing using a crushing-and-softening machine with several wooden rolls on shaft and provided with a far-infrared heating unit. The resultant sheet material was a leatherlike sheet material which had a kangaroo-like design and was rich in softness, at the same time whose base material layer (I) was adequately strong in stiffness, and whose surface had excellent sibo feeling. The leatherlike sheet material was sliced at the boundary between the base material layer (I) and the grained surface layer (II), and the thickness and the apparent density of each of the base material layer (I) and the grained surface layer (II) were measured. The determined characteristic values are shown in Table 1. On the other hand, a product of Comparative Example 1 which was obtained without applying a pressing treatment nor rubbing processing had hard touch and large buckling crease, and it was not leatherlike.

Example 2

A mixed solvent of DMF and methyl ethyl ketone (hereafter, abbreviated as MEK) in a ratio (DMF:MEK) of 70:30 was applied by using a gravure roll on the porous-layer surface of the sheet material having a surface porous layer (D), which was produced in Example 1, and the sheet material was dried. Thus, the surface skin layer was dissolved to form open pores. The sheet material was treated with hot toluene as in Example 1 to convert the constituting fibers into ultrafine fibers. When compared with Example 1, the solvent permeability of the surface coat of this sheet material was superior, and accordingly the extraction time was shortened by 30%.

Subsequently, the polyurethane coating material for surface finishing layer (E) which had been used in Example 1 was applied by using a gravure roll, and the subsequent processes were carried out as in Example 1. The characteristic properties of the obtained sheet material are shown in Table 1. The air permeability and moisture permeability were superior to those of the products in Example 1. Further, the photograph of the surface of the obtained sheet material taken by a scanning electron microscope revealed that fine pores of 0.5 to 15 $\mu$m in pore size were present on the surface as much as 112 pores/cm$^2$.

Examples 3-(1) and (2), and Comparative Examples 2 and 3

Two kinds of polyurethane elastomers whose 100%-elongation modulus were 80 kg/cm$^2$ and 260 kg/cm$^2$ were synthesized in Examples 3-(1) and 3-(2), respectively by, using the same raw materials as in Example 1 for producing the high molecular elastomer (B), but changing the amounts of charge independently in Examples 3-(1) and 3-(2). Their softening points were 175° C. and 210° C., respectively. According to the same conditions as in Example 1 with the exception that one of these polyurethane elastomers was used as the high molecular elastomer (B), a surface finishing layer (E) was formed on the surface porous layer (D). The sheet material was pressed under conditions shown in Table 2, and the pressed sheet material was subjected to the rubbing processing. The characteristic properties of the products are shown in Table 2. The obtained two kinds of leatherlike sheet materials were each sliced at the boundary between the base material (I) and the grained surface layer (II), and the ratio of the fiber component to the sum of the high molecular elastomer (B) and the high molecular elastomer (C) in the base material (I) was determined by a solvent extraction method, and it was 57:43, for both the two kinds.

Further, in Comparative Examples 2 and 3, the sheet materials were produced in the same way as in Example 3-(1) and (2), respectively, with the exception that they were not subjected to the press treatment nor the rubbing processing. The results are shown in Table 2.

Example 4 and Comparative Examples 4 to 7

Preparation of Nonwoven Fabric (a)

Nylon 6 and polyethylene (MI=20 g/10 min) were spun in such a manner so as to produce fibers having the structure of a cross-section in which a hollow space is emcompassed with alternately arranged and adhered 48 layers. The obtained fibers were side-by-sidle composite fibers having a fineness of 4.5 de and a cut length of 51 mm.

The fibers were converted into web by using a card and a cross layer, and the web was needle punched at a punching density of 1000 punches/cm$^2$ by using a needle locker. Subsequently, the web was heated in a hot-air chamber at 150° C. and pressed with a calender roll at 90° C. to obtain a nonwoven fabric (a) having a weight of 520 g/m$^2$, a thickness of 2.0 mm and an apparent density of 0.26 g/cm$^3$.

Preparation of Impregnation Solution

A mixture of a polytetramethylene glycol (Mw of 1480) and a polycaprolactone (Mw of 1540) at a molar ratio of 50/40 as a polymer diol, diphenylmethane diisocyanate and ethylene glycol were made to react with each other in DMF to obtain a polyurethane elastomer (100%-elongation modulus of 90 kg/cm$^2$; and softening point of 185° C.). To a 13% solution of the obtained polyurethane elastomer were added an alkylene ether-modified silicone, a carbinol-modified silicone, a cellulose-based additive and a black toner to prepare an impregnation solution.

Preparation of Surface Coating Solution

To a 20% solution in DMF of the polyurethane elastomer obtained in the above-mentioned "Preparation of Impregnation Solution" were added an alkylene ether-modified silicone, a carbinol-modified silicone, a cellulose-based additive and a black toner to prepare al surface coating solution.

Preparation of Base Material (I) Having Porous Layer

Said nonwoven fabric (a) was immersed into said impregnation liquid, then the impregnated nonwoven fabric was introduced onto rotating metallic rolls, the impregnated liquid was squeezed out while the nonwoven fabric was pressed onto the metallic roll and compressed until its thickness becomes 85% of the original thickness by using a doctor knife utilizing the springing of a steel plate, and said coating liquid was applied onto the impregnated nonwoven fabric in an amount of 600 g/m$^2$ at the outlet side before the compression get recovered. Subsequently, the nonwoven fabric was immersed into a 12% DMF coagulation bath to coagulate the impregnated elastomer, and it was washed to remove the solvent followed by drying. Subsequently, the nonwoven fabric was immersed into hot toluene at 80° C. to remove the polyethylene of one component in the side-by-side composite fiber by extraction, and thereby ultra fine fibers were obtained. The obtained ultrafine fibers had an average single fineness of 0.1 de.

Through these processes, a sheet material in which a high molecular elastomer (C)-constituted surface porous layer (D) was formed on one side of the surfaces of the base material (I) was, obtained. The observation of the structure of the cross-section of the obtained sheet material by a scanning electron microscope revealed that the polyurethane resin was coagulated with slight spaces around fibers, that is, the sheet material had substantially a non-contacting structure, and further the high molecular elastomer (C) was sunk into the base material (II) by about 0.15 mm. Further, the sheet material was sliced at the boundary between the base material (I) and the surface porous layer (D), and the ratio of the fiber component to the sum of the high molecular elastomer (B) and the high molecular elastomer (C) in the base material (I) was determined by a solvent extraction method, and it was 62:38.

Formation of Surface Finishing Layer (E)

A coating material prepared by adding a black toner to an organic solvent solution containing 10% polyurethane resin (aromatic isocyanate-based polyester/polyether polyurethane; 100%-elongation modulus of 250 kg/cm$^2$) was used for forming the surface finishing layer (E). The coating material was applied twice on the surface porous layer (D) of the base material by using a gravure roll having a 110 mesh size, and the coated base material was dried and then embossed at 180° C. by using an embossing pattern of a calf skin-pore design. A coating material prepared by adding a gloss-adjusting agent (silica) to the above prepared coating material was further applied single time by using a gravure roll having a 110 mesh size, and the base material was dried. Thus resultant sheet material had a thickness of 1.40 mm, a weight of 530 g/m$^2$ and an apparent density of 0.38 g/cm$^3$.

Pressing Treatment

Subsequently, the base material (I)-side and the grained surface layer (II)-side of the obtained sheet material were brought in contact with smooth metallic rolls at 160° C. and at 80° C., respectively, and the sheet material was pressed at a pressing pressure of 100 kg/cm linear load) and a linear velocity of 2 m/min.

Rubbing Processing

The pressed sheet material was subjected to a rubbing processing using a crushing-and-softening machine with several wooden rolls on shaft and provided with a far-infrared heating unit. The resultant sheet material was a leatherlike sheet material which had a kangaroo-like design and was rich in softness, at the same time whose base layer (I) was adequately strong in stiffness, and whose surface had excellent sibo feeling. The leatherlike sheet material was sliced at the boundary between the base material layer (I) and the grained surface layer (II), and the thickness and the apparent density of each of the base material layer (I) and the grained surface layer (II) were measured. The determined characteristic values are shown in Table 3.

Comparative Example 8

The base material (I)-side and the grained surface layer (II)-side of the sheet material that was produced in Example 1 but that was not subjected to the pressing treatment yet were brought in contact with smooth metallic rolls having a surface temperature of 220° C. and 80° C., respectively, and then the sheet material was pressed at a pressure of 650 kg/cm (linear load) and a linear velocity of 2 m/min. In the resultant sheet material, the impregnated resin was partially fused, and the sheet material had hard touch, and it was paper-like and poor in leather like characteristics. The results are shown in Table 3.

Comparative Example 9

The sheet material that was produced in Example 1 but that was not subjected to the pressing treatment yet was pressed at a temperature of 80° C., a pressure of 50 kg/cm and a linear velocity of 2 m/min. The resultant sheet material exhibited little density-increasing effect produced by a pressing treatment, and it was short in body feeling and insufficient in folding sibo feeling (folding crimps) on the surface. The results are shown in Table 3.

Comparative Examples 10 and 11

Polyurethane elastomer having a 100%-elongation modulus of 30 kg/cm$^2$ (Comparative Example 10) and that having a 100%-elongation modulus of 180 kg/cm$^2$ (Comparative Example 11) were used as the high molecular elastomer (C) in Example 1, and leatherlike sheet materials were produced according to the method of Example 1-(2).

The leatherlike sheet material produced by using the polyurethane elastomer having a 100%-elongation modulus of 30 kg/cm$^2$ had soft touch, but it had stronger resiliency and was somewhat rubber-like.

The leatherlike sheet material produced by using the polyurethane elastomer having a 100%-elongation modulus of 180 kg/cm$^2$ had hard touch, especially its hardness was largely increased at a low temperature, and hence it was not preferable.

Comparative Example 12

A polyurethane elastomer having a 100%-elongation modulus of 30 kg/cm$^2$ and a softening temperature of 120° C. was prepared by using the same kinds of raw materials as in Example 1, but by changing the charging composition. A leatherlike sheet material was produced according to the method of Example 1-(2) by using the above-mentioned polyurethane elastomer as the high molecular elastomer (B) and by pressing at 180° C.

In the obtained leatherlike sheet material, the impregnated resin was fused, and the leatherlike sheet material had little non-bonded structure, and exhibited a strong resiliency, and it was rubber-like. The results are shown in Table 3.

Comparative Example 13

A mixture of a polytetramethylene glycol (Mw of 600) and a polycaprolactone (Mw of 850) at a molar ratio of 60/40 as the polymer diol, diphenylmethane diisocyanate and ethylene glycol were made to react with each other in DMF to obtain a polyurethane elastomer (100%-elongation modulus of 330 kg/cm$^2$; and softening temperature of 215° C.). To a 15% solution of the obtained polyurethane elastomer were added an alkylene ether-modified silicone, a carbinol-modified silicone, a cellulose-based additive and a black toner to prepare an impregnation solution.

Using this solution in the place of the impregnation solution in Example 1, the processes were carried out according to the method of Example 1-(2) with the exception that the pressing treatment was carried out at 180° C. at a linear velocity of 1 m/min. The obtained sheet material had hard touch, and still it had some stuffer feeling. The results are shown in Table 3.

TABLE 1

| | Comparative Example 1 | Example 1-(1) | Example 1-(2) | Example 1-(3) | Example 2 |
|---|---|---|---|---|---|
| Average single fineness (de) of nonwoven fabric (A) | 0.003 | 0.003 | 0.003 | 0.003 | 0.003 |
| Apparent density (g/cm$^3$) of base material (I) | 0.37 | 0.40 | 0.43 | 0.47 | 0.40 |
| Weight ratio of (A):{(B) + (C)} in base material (I) | 56:44 | 56:44 | 56:44 | 56:44 | 56:44 |
| Thickness (mm) of grained surface layer (II) | 0.12 | 0.11 | 0.11 | 0.10 | 0.11 |
| 20%-elongation load (longitudinal) (kg/cm) (σ20) | 3.4 | 3.0 | 3.2 | 3.2 | 3.0 |
| 5%-elongation load (longitudinal) (kg/cm) (σ5) | 0.9 | 0.5 | 0.6 | 0.6 | 0.5 |
| σ20/σ5 (longitudinal) | 3.8 | 6.0 | 5.3 | 5.3 | 6.0 |
| 20%-elongation load (transverse) (kg/cm) (σ20) | 0.9 | 0.7 | 0.7 | 0.7 | 0.7 |
| 5%-elongation load (transverse) (kg/cm) (σ5) | 0.20 | 0.08 | 0.08 | 0.08 | 0.08 |
| σ20/σ4 (transverse) | 4.5 | 8.7 | 8.7 | 8.7 | 8.7 |
| Peel-off strength (kg/cm) between base material (I) and grained surface layer (II) | 2.74 | 2.79 | 2.70 | 2.75 | 2.70 |
| Pore size (μm) of fine pore | 0 | 0 | 0 | 0 | 0.5 to 15 |
| Number of fine pore (pores/cm$^2$) | 0 | 0 | 0 | 112 | |
| Moisture permeability (mg/cm$^2$ · hr) | 5.2 | 5.0 | 5.0 | 5.1 | 7.2 |
| Air permeability (l/cm$^2$ · hr) | 0 | 0 | — | — | 1.2 |
| Pressing pressure (P) (kg/cm) | 0 | 35 | 200 | 400 | 35 |
| Pressing temperature (T)(° C.) | — | 180 | 180 | 180 | 180 |
| P × T | — | 6,300 | 36,000 | 72,000 | 6,300 |
| Touch | X | ◎ | ○ | ○ | ◎ |
| Body strength | X | ○ | ○ | ◎ | ○ |
| Surface sibo feeling | X | ○ | ○ | ○ | ○ |

TABLE 2

| | Comparative Example 2 | Example 3-(1) | Comparative Example 3 | Example 3-(2) |
|---|---|---|---|---|
| Average single fineness (de) of nonwoven fabric (A) | 0.003 | 0.003 | 0.003 | 0.003 |
| Apparent density ($g/cm^3$) of base material | 0.37 | 0.42 | 0.36 | 0.42 |
| Weight ratio of (A):{(B) + (C)} in base material (I) | 57:43 | 57:43 | 57:43 | 57:43 |
| Thickness (mm) of grained surface layer (II) | 0.13 | 0.11 | 0.12 | 0.12 |
| 20%-elongation load (longitudinal) (kg/cm) (σ20) | 3.3 | 3.0 | 3.5 | 3.2 |
| 5%-elongation load (longitudinal) (kg/cm) (σ5) | 0.9 | 0.6 | 1.0 | 0.8 |
| σ20/σ5 (longitudinal) | 3.7 | 5.2 | 3.5 | 5.1 |
| 20%-elongation load (transverse) (kg/cm) (σ20) | 0.9 | 0.7 | 0.9 | 0.7 |

TABLE 2-continued

| | Comparative Example 2 | Example 3-(1) | Comparative Example 3 | Example 3-(2) |
|---|---|---|---|---|
| 5%-elongation load (transverse) (kg/cm) (σ5) | 0.20 | 0.09 | 0.23 | 0.08 |
| σ20/σ5 (transverse) | 4.5 | 7.8 | 3.9 | 8.8 |
| Peel-off strength (kg/cm) between base material (I) and grained surface layer (II) | 2.70 | 2.72 | 2.65 | 2.63 |
| Pressing pressure (P) (kg/cm) | 0 | 100 | 0 | 100 |
| Pressing temperature (T) (° C.) | — | 130 | — | 180 |
| P × T | — | 13,000 | — | 18,000 |
| Touch | X | ◎ | X | ○ |
| Body strength | X | ○ | X | ○ |
| Others | stuffer feeling | — | — | — |

TABLE 3

| | tive Example 4 | Comparative Example 8 | Comparative Example 9 | Comparative Example 12 | Comparative Example 13 |
|---|---|---|---|---|---|
| Average single fineness (de) of nonwoven fabric (A) | 0.1 | — | — | — | — |
| Apparent density ($g/cm^3$) of base material (I) | 0.43 | 0.78 | 0.36 | 0.62 | 0.40 |
| Weight ratio of {(A):(B) + (C)} in base material (I) | 62:38 | 62:38 | 62:38 | 62:38 | 62:38 |
| Thickness (mm) of grained surface layer (II) | 0.15 | 0.09 | 0.13 | 0.10 | 0.11 |
| 20%-elongation load (longitudinal) (kg/cm) (σ20) | 4.20 | 2.9 | 3.3 | 3.3 | 3.6 |
| 5%-elongation load (longitudinal) (kg/cm) (σ5) | 0.8 | 0.7 | 0.8 | 1.0 | 1.0 |
| σ20/σ5 (longitudinal) | 5.3 | 4.1 | 4.1 | 3.3 | 3.6 |
| 20%-elongation load (transverse) (kg/cm) (σ20) | 1.0 | 0.8 | 0.9 | 0.9 | 1.0 |
| 5%-elongation load (transverse) (kg/cm) (σ5) | 0.15 | 0.13 | 0.20 | 0.23 | 0.30 |
| σ20/σ4 (transverse) | 6.7 | 4.5 | 4.5 | 3.9 | 3.3 |
| Peel-off strength (kg/cm) between base material (I) and grained surface layer (II) | 2.8 | 2.45 | 2.75 | 2.65 | 2.63 |
| Pressing pressure (P) (kg/cm) | 100 | 650 | 50 | 200 | 200 |
| Pressing temperature (T) (° C.) | 160 | 220 | 80 | 180 | 180 |
| P × T | 16,000 | 14,300 | 4,000 | 36,000 | 36,000 |
| Touch | ○ | rubber like | X | rubber like | X |
| Body strength | ○ | ○ | X | ○ | ○ |

INDUSTRIAL FIELD OF APPLICATION

A leatherlike sheet material of the present invention has a kangaroo-like design, excellent air permeability and moisture permeability, and soft touch, does not extend too much even receiving large deforming power and has a certain limiting condition of elongation. Further, the leatherlike sheet material has high peel-off strength between the base material (I) and the grained surface layer (II), and it is suited for use as materials for shoes or the like.

What is claimed is:

1. A method for producing a leatherlike sheet which has a base material (I) comprising a nonwoven fabric (A) constituted with ultrafine-fiber bundles having single fineness of no greater than 0.2 de, a high molecular elastomer (B) and a high molecular elastomer (C), and in which a grained surface layer (II) comprising a high molecular elastomer (C)-constituted surface porous layer (D) and a surface finishing layer (E) is formed on at least one side of the surfaces of the base material, wherein the method is characterized in that (5) for producing the base material (I), a nonwoven fabric (a) constituted with fibers convertible into ultrafine-fiber bundles is impregnated with a solution of the high molecular elastomer (B), the nonwoven fabric (a) is compressed to the thickness of; 95% or less of the original thickness to be squeezed, successively a solution of the high molecular elastomer (C) is applied on the nonwoven fabric (a) before getting recovered from the compression to make a part of this solution permeate into the nonwoven fabric (a), subsequently the high molecular elastomer (B) and the high molecular elastomer (C) in the nonwoven fabric (a) are made to coagulate in such a state where they are substantially free from contact with the fibers convertible into ultrafine-fiber bundles constituting the nonwoven fabric (a), and the treated nonwoven fabric (a) is subjected to a solvent removing process and a drying process, (6) the high molecular elastomer (C)-constituted surface porous layer (D) is formed on at least one side of the surfaces of the base material (I), subsequently the nonwoven fabric (a) is treated for converting the constituting fibers into ultrafine fibers, and the resultant nonwoven fabric is pressed at a temperature in the range from the softening temperature minus 100° C. to the softening temperature minus 10° C. satisfied at the same time for the high molecular elastomer (B) and the high molecular elastomer (C) to reduce its thickness into 60 to 95% of the original thickness before or after the formation of a finishing layer (E) further on the surface, and (7) the leatherlike sheet material comprising the base material (I) and the grained surface layer (II) is subjected to a rubbing processing so that the ratios of 20%-elongation load ($\sigma 20$)/5%-elongation load ($\sigma 5$) in the longitudinal direction and the transverse direction of the leatherlike sheet material become each not less than 5 nor more than 20.

2. An artificial leather according to claim 1, wherein the peel-off strength between the base material (I) and the grained surface layer (II) at least 2.5 kg/cm.

3. An artificial leather according to claim 1 or claim 2, wherein fine pores having pore sizes of 0.5 to 40 $\mu$m exist on the grained surface layer (II) at a density of at least 50 pores/cm$^2$.

4. An artificial leather according to claim 3, wherein the artificial leather has a moisture permeability of at least 5 mg/cm$^2$·hr and an air permeability of at least 0.5/cm$^2$·hr.

5. An artificial leather according to claim 1 or claim 2, wherein the 100%-elongation modulus of the polymeric elastomer (B) is from 40 to 300 kg/cm$^2$.

6. An artificial leather according to claim 1 or claim 2, wherein the 100%-elongation modulus of the polymeric elastomer (C) is from 40 to 150 kg/cm$^2$.

* * * * *

UNITED STATES PATENT AND TRADEMARK OFFICE

CERTIFICATE OF CORRECTION

PATENT NO. : 6,451,716 B1 
DATED : September 17, 2002
INVENTOR(S) : Kunihiko Sasaki and Yoshiyuki Suzuki It is certified that error appears in the above-identified patent and that said Letters Patent is hereby corrected as shown below:

Column 19, line 12, to Column 20, line 20,
Delete claim 1 in its entirety and insert the following:

-- 1. An artificial leather comprising a base material (I) and at least one grained surface layer (II), the ratios of 20% elongation load to 5% elongation load in the longitudinal and traverse directions not less than 5 nor more than 20;

said base material (I) comprising a nonwoven fabric (A), a polymeric elastomer (B), and a polymeric elastomer (C), wherein polymer elastomers (B) and (C) may be either the same or different polymer elastomers;

said nonwoven fabric (A) made of ultrafine fiber bundles comprising ultrafine fibers, wherein said fibers have a single average fineness of no greater than 0.2 de;

said polymeric elastomer (C) bordering the surface layer (II) and laminated to the base material (I);

said base material (I) having:

(1) a weight ratio of the nonwoven fabric (A) to the polymeric elastomer (B) and the polymeric elastomer (C) from 45:55 to 69:31, and (2) a density from 0.37 to 0.65 g/cm$^3$, said grained surface layer (II) comprising a surface porous layer (D) and a surface finishing layer (E);

said surface porous layer (D) constituted by the polymeric elastomer (C);

said surface porous layer (D) bordering the base material (I);

said surface finishing layer (E) situated on the top of the surface porous layer (D);

said grained surface layer (II) having a thickness of from 0.01 to 0.18 mm, wherein said artificial leather is subjected to a pressing treatment at a temperature that is from 0ºC to 100ºC lower than the softening temperature of elastomer (B). --

Signed and Sealed this

First Day of April, 2003

JAMES E. ROGAN
*Director of the United States Patent and Trademark Office*